United States Patent [19]

Leibowitz

[11] 3,935,663

[45] Feb. 3, 1976

[54] FLYING TOY

[76] Inventor: Martin N. Leibowitz, 1620 Oak Meadows Drive, Irving, Tex.

[22] Filed: July 22, 1974

[21] Appl. No.: 490,368

[52] U.S. Cl. ..... 46/60; 46/74 R; 46/74 D

[51] Int. Cl.[2] ..... A63H 27/12

[58] Field of Search ..... 46/61, 63, 74 D, 75

[56] References Cited

UNITED STATES PATENTS

| | | | |
|---|---|---|---|
| 1,537,312 | 5/1925 | Korona | 46/66 |
| 2,835,073 | 5/1958 | Dame | 46/74 D |
| 3,508,360 | 4/1970 | Williams | 46/75 |
| 3,603,033 | 9/1971 | Mueller | 46/74 D |
| 3,802,117 | 4/1974 | Englehardt | 46/61 |

*Primary Examiner*—Russell R. Kinsey
*Assistant Examiner*—Robert F. Cutting
*Attorney, Agent, or Firm*—Richards, Harris and Medlock

[57] ABSTRACT

The specification discloses a flying toy for being thrown through the air with a spinning motion. The toy includes a circular disc having a convex outer surface and a concave inner surface. The disc is configured to produce lifting effects when thrown with a spinning motion. The toy includes a circular reel attached to the center of the convex outer surface, the reel comprising an outer hub and a stem of reduced diameter. A flexible line is wound around the stem of the reel and is grasped at one end in order to impart additional spin to the disc when the toy is thrown through the air. Vent openings are formed symmetrically about the disc in order to create additional lift to the disc when thrown.

6 Claims, 5 Drawing Figures

FLYING TOY

FIELD OF THE INVENTION

This invention relates to toys, and more particularly relates to a flying toy thrown through the air with a spinning motion.

THE PRIOR ART

Various designs of concave-convex flying discs have herefor been developed, such discs normally being thrown through the air with a spinning motion. While such spinning discs have become quite popular, the distance which such prior discs may be thrown and the time in which the such discs remain aloft is dependent upon the skill of the user and the amount of spin imparted upon the device by the user. The need has thus arisen for a flying toy in which a substantial amount of spin may be provided to the toy by a relatively unskilled user, such that the toy may travel over extended distances and fly at substantial heights for extended periods of time.

SUMMARY OF THE INVENTION

In accordance with the present invention, a flying device includes a circular body having a convex exterior and a concave interior. A reel is centered on the convex exterior of the body. A flexible line is provided for being received by the reel in order to impart spin to the body when the body is thrown and the end of the flexible line is grasped by the user.

In accordance with a more specific aspect of the invention, a flying toy is disclosed which may be thrown through the air with a spinning motion. The toy includes a circular disc having a convex outer surface and configured to produce lifting effects when thrown with a spinning motion. A circular reel is attached in the center of the convex outer surface and includes an outer hub and a stem of reduced diameter. A flexible line is adapted to be wound around the stem of the reel and for being grasped at the end thereof in order to impart additional spin to the disc when the disc is thrown. Vent openings are formed about the disc in order to create additional lift to the disc when the disc gets thrown.

BRIEF DESCRIPTION OF THE DRAWING

For more complete understanding of the present invention and for further objects and advantages thereof, reference is now made to the following description taken in conjunction with the following drawings, in which.

DESCRIPTION OF THE PREFERRED EMBODIMENT

Figure 1:
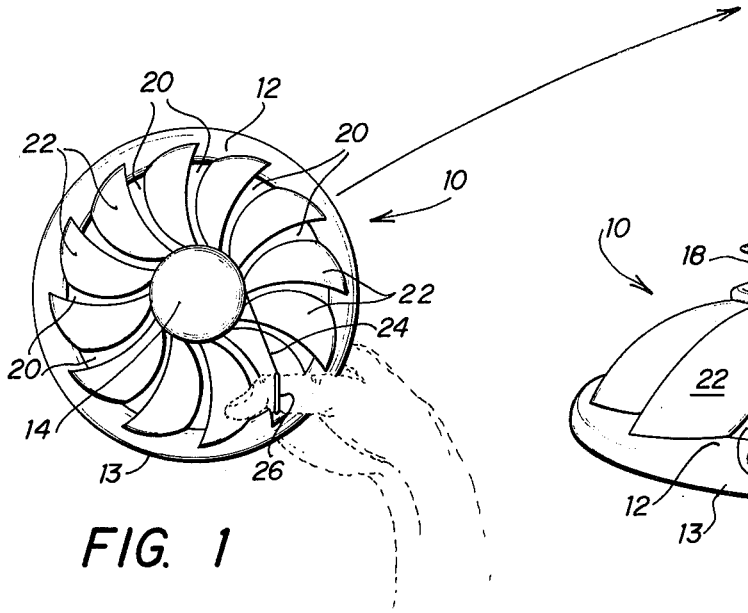
FIG. 1 is a top view of the preferred embodiment of the present toy prior to being thrown with a spinning motion.
Figure 2:
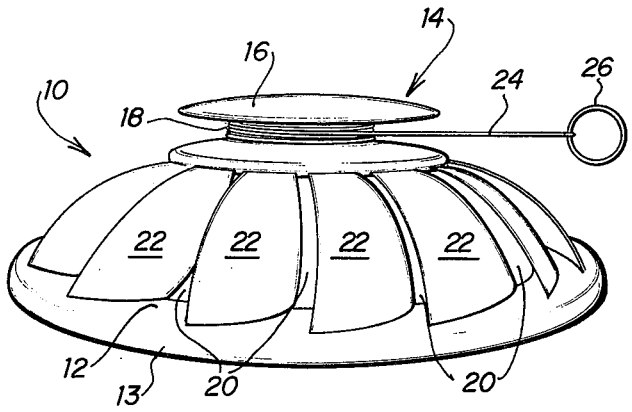
FIG. 2 is a side view of the flying toy shown in FIG. 1.

Referring to FIGS. 1 and 2, the present flying toy is identified generally by the numeral 10 and comprises a circular disc 12 having a bowl-like configuration with a convex exterior and a concave interior. The rim 13 of the body 12 is provided with a streamlined air-foil configuration to create the desired lift and the gyroscopic effects upon the toy 10 when thrown. A reel 14 is rigidly connected to the center of the exterior of the body 12 and includes an outer hub 16 and a neck or stem 18 of reduced diameter.

A plurality of vent openings 20 are symmetrically formed through the body 12. As shown in FIG. 2, the vent openings 20 are defined by plurality of vane members 22 provided with curved surfaces. A flexible line 24 may comprise a string or the like and is adapted to be wound about the stem 18 of the reel 14. The end of the line 24 is connected to a ring 26.

In operation of the toy, the line 24 is wound about the reel 14 in the manner illustrated in FIGS. 1 and 2. The thumb or finger of the user is then inserted through the ring 26 and the toy 10 is firmly grasped by the hand of the user in the manner illustrated in FIG. 1. The toy 10 is then thrown through the air by snapping the wrist of the user to impart a spinning motion to the toy. At the same time, the line 24 becomes unreeled from the reel 14, thereby imparting additional spinning motion to the toy. The vent openings 20 and the vanes 22 operate to collect air beneath the toy during its motion, thereby imparting greater lift to the toy.

The combined effects of the additional spin imparted by the line 24, and the increased lift provided by the vent openings 20 and vanes 22, thus cause the toy 10 to travel at substantial heights and distances. The user is able to quite quickly determine the proper angle of attack when throwing the toy 10 in order to derive the desired gyroscopic lift effects upon the disc to provide substantial height and distances when throwing the device.

Figure 3:
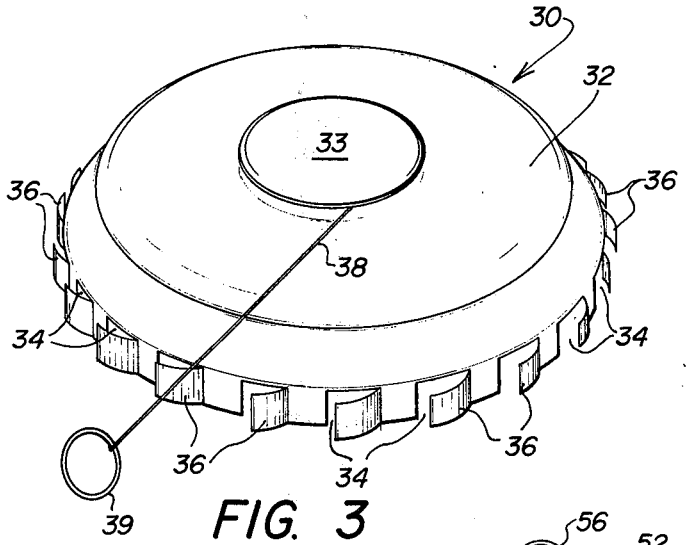
FIG. 3 is a perspective view of a second embodiment of the present flying toy.

FIG. 3 illustrates a second embodiment of the toy which is illustrated generally by a numeral 30. In this embodiment, the toy 30 includes a bowl-shaped convex-concave body 32 having a reel 33 shaped in the manner previously described. In this embodiment, instead of having vent opening disposed between the periphery of the body and the reel, the vent openings 34 are formed about the periphery of the body 32. The vent openings 34 are provided with general rectangular configurations and are created by a plurality of rectangular vanes or flaps 36 that extend radially outwardly from the body 32. A flexible line 38 is adapted to be wound around the reel 33 in the manner previously described and includes a ring 39.

Operation of the toy shown in FIG. 3 is the same as that previously described, in that the ring 39 is grasped by the user when the toy 30 is thrown with a spinning motion. The flexible line 38 causes additional spin to be imparted to the toy 30 due to the unwinding of the line from the reel 14, while the vent openings 34 and vanes 36 operate to provide substantial lift to the toy.

Figure 4:
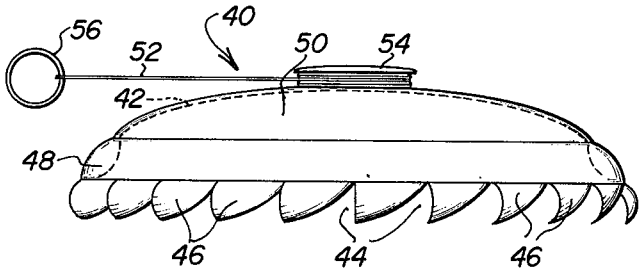
FIG. 4 is a side view of a third embodiment of the present flying toy.

FIG. 4 illustrates a third embodiment of the invention and is generally identified by the numeral 40. This embodiment includes a bowl-shaped body 42 configured similar to the device shown in FIG. 3. In this embodiment, the vent openings 44 are formed from a plurality of curved sawteeth vanes 46 which extend downwardly from the rim 48 of the body 42. FIG. 4 illustrates by the dotted lines 50 the concave inner surface of the body 42 and illustrates the streamlined airfoil shape of the rim 48. A flexible line 52 is adapted to be wound about the reel 54 of the body 42 and includes a ring 56 for being grasped by the user such that the device may be thrown in the manner previously described.

Figure 5:
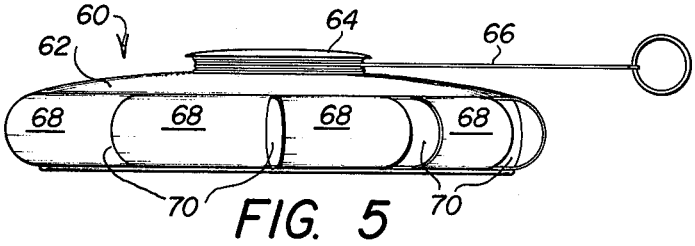
FIG. 5 is a side view of a fourth embodiment of the present flying toy.

Referring to FIG. 5, a fourth embodiment of the toy generally identified by the numeral 60 is illustrated. The device shown in FIG. 5 includes a bowl-shaped body 62 having a reel 64 for receiving a flexible line 66 in the manner previously described. In this embodiment, the periphery of the body 62 is provided with a substantial depth and includes outwardly extending curved vanes 68 which are spaced apart by vent openings 70. When toy 60 is thrown in the manner previously described, the toy 60 will travel for substantial distances and at substantial heights due to the operation of the flexible line 66, the vane 68 and the openings 70.

It will be understood that in some instances that it may be desirable to throw the present flying toy without the use of the string. In this instance, the toy is thrown in the same manner as that previously described with respect to FIG. 1, except that the string 24 is not utilized. The toy operates in this mode of operation in a similar manner as when thrown with the string, except that somewhat less spin is applied to the toy. However, due to the vent openings and vanes about the periphery of the toy, a substantial amount of lift will be provided to the toy when thrown in this manner.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. A free flight flying toy for being tossed through the air with a spinning motion comprising:

a circular disc having a convex outer surface comprising the upper surface when in operation and configured to produce lifting effects when tossed with a spinning motion, a circular reel attached to the center of said convex outer surface and extending above said disc when in operation, said reel including an outer hub portion and a stem of less diameter than said hub portion, a flexible line having a free end for being wound around said stem of said reel and for being grasped at the other end in order to impart additional spin to said disc by unwinding after said disc is tossed, said free end of said line disengaging from said reel when said line is fully unwound to provide free flight to said disc, and vent openings being formed at equally spaced points about said disc in order to create additional lift to said disc.

2. The flying device of claim 1 wherein said flexible line includes a ring on the end thereof for receiving a portion of the thrower's hand during throwing of said body.

3. The flying toy of claim 1 wherein said vent openings are disposed about the periphery of said disc.

4. The flying toy of claim 1 wherein said vent openings are curved.

5. The flying toy of claim 1 wherein said vent openings are generally rectangular.

6. The flying toy of claim 1 wherein said vent openings include vane members extending outwardly from the body of said disc.

* * * * *